United States Patent [19]

Tornero

[11] Patent Number: 4,938,534

[45] Date of Patent: Jul. 3, 1990

[54] CHAIR WITH INDEPENDENTLY COLLAPSIBLE ARMREST AND METHOD OF OPERATION

[76] Inventor: Marta Tornero, 6117 Ballinger Rd., Greensboro, N.C. 27410

[21] Appl. No.: 369,341

[22] Filed: Jun. 21, 1989

[51] Int. Cl.[5] ..... A47C 7/59

[52] U.S. Cl. ..... 297/417; 297/35

[58] Field of Search ..... 297/27, 28, 35, 417

[56] References Cited

U.S. PATENT DOCUMENTS

| | | | |
|---|---|---|---|
| 336,662 | 2/1886 | Philips | 297/27 |
| 2,708,962 | 5/1955 | Rechler | 297/35 X |
| 3,165,354 | 1/1965 | Egger | 297/35 X |
| 4,832,406 | 5/1989 | Adams et al. | 297/417 |

FOREIGN PATENT DOCUMENTS

| | | | |
|---|---|---|---|
| 133077 | 4/1933 | Austria | 297/26 |
| 520407 | 4/1940 | United Kingdom | 297/26 |

*Primary Examiner*—Peter A. Aschenbrenner

[57] ABSTRACT

A chair seat is provided with track means and the arm support strut with sliding means for retraction of the armrests from one extended position when the armrests are in use, to one collapsed position conveniently and aesthetically out of the way when the armrests are not in use or to permit easier user access and chair mobility.

7 Claims, 4 Drawing Sheets

CHAIR WITH INDEPENDENTLY COLLAPSIBLE ARMREST AND METHOD OF OPERATION

BACKGROUND OF THE INVENTION

This invention relates in general to seating articles and more particularly to chairs of the type with collapsible armrests to prevent their interference with desks, work stations or other structures, or to permit easy access to the seat by the user such as in aircraft passenger or pilot cabins.

PRIOR ART

My U.S. Pat. No. 4,832,406 discloses such a chair (see FIG. 1), with collapsible armrests comprising an arm at each side of the chair, the arm having a rear end pivotally connected to and supported by the back of the chair; an arm support strut having an upper end pivotally connected to the forward end of the arms and having a lower end pivotally connected to the seat. The chair back is vertically slidable on the chair back support to permit operation of the armrests. With this arrangement, which results in a highly sturdy, efficient and extremely aesthetic design, the user can collapse the arms out of the way with a minimum of effort, and the chair arms remain integral to the chair, accessible, and pleasantly unobtrusive.

In spite of the obvious novelty and advantages of the above mentioned chair construction, a need exists for further improvement leading to even easier armrest operation and simplicity in manufacture while preserving sturdiness and atttractiveness.

SUMMARY OF THE INVENTION

The armrests can be moved in and out of an operative position independently of the chair back by means of a track, object of the invention. To that end, a chair arm is pivotally attached at its rear end to the back of the chair and is pivotally attached at its front end to the upper end of a support strut which in turn is pivotally and slidably attached at its lower end to an elongated slotted track on the side of the chair seat. The arm and its support strut are movable from a raised position wherein the arm extends generally horizontally, and the strut extends generally vertically to a retracted or collapsed position, wherein the arm extends generally vertically adjacent the side of the chair back, and the strut extends generally horizontally adjacent the edge of the chair seat.

With this arrangement, and in accordance with the method of the invention, the lower end of the support strut can be easily made to disengage a limit slot on the track and slide forward, guided by the track, moving the arm and the strut to a temporary straight position and then pivoting the forward end of the arm and the upper end of the strut rearwardly and downwardly.

Advantageously, the chair armrest may be easily moved to or from its two positions while the occupant is seated in the chair. Also, one arm can be moved to its retracted position while the other remains in its raised position for situations in which such an arrangement is desired. Thus also, a series of chairs in side-by-side relation can be easily adjusted to so-called bench seating.

DETAILED DESCRIPTION OF THE DRAWINGS

Figure 2:
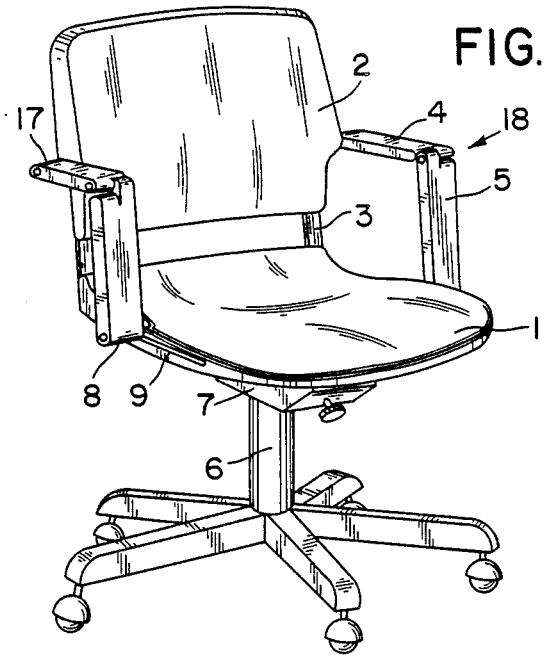
FIG. 2 is a perspective view of the chair showing the object of the invention.
Figure 3:
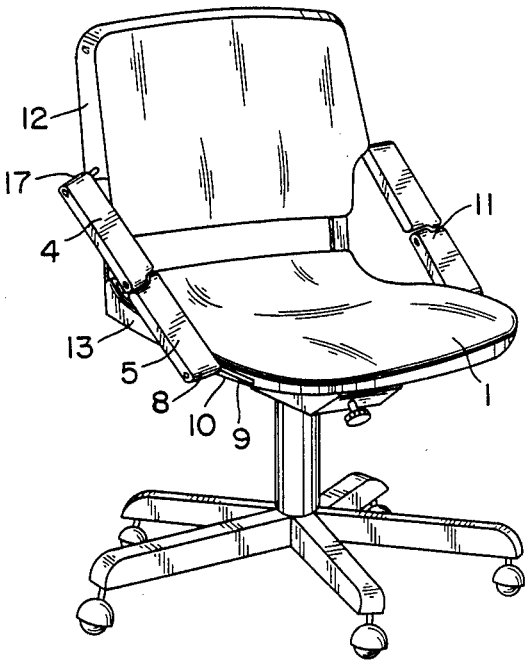
FIG. 3 is a perspective view of the chair of FIG. 2 with the arms in a position midway between the raised position and a retracted position.
Figure 4:
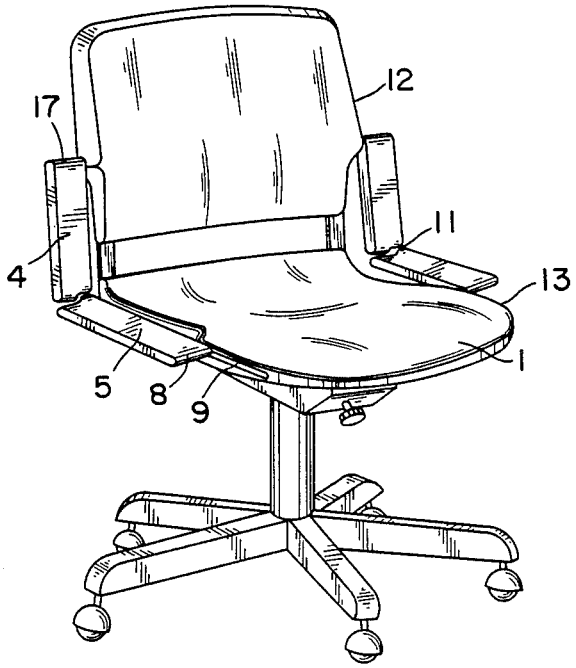
FIG. 4 is a perspective view of the chair of FIG. 2 with the arms in the retracted position.

Referring to FIGS. 2–4 the chair includes a chair seat 1, a chair back 2, a back support 3, a pair of arms 4 and a pair of struts 5. The chair seat is mounted on a suitable support such as a pedestal 6 with an adjustable control unit 7.

Figure 1:
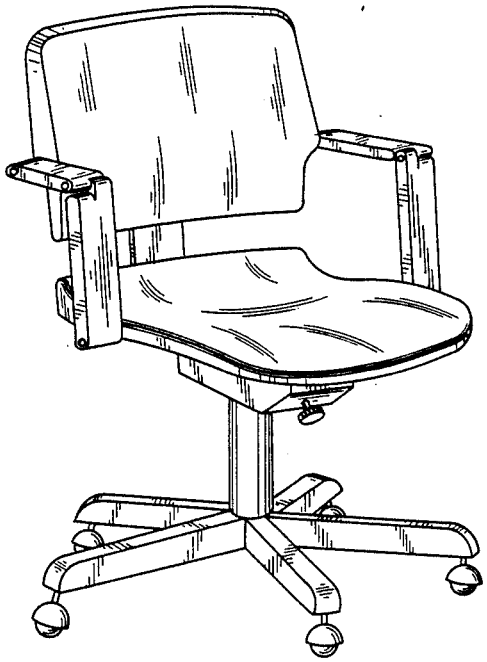
FIG. 1 is a perspective view of the chair of the prior art.

In FIG. 2, the chair arms 18 are raised into a normal position wherein they extend generally horizontally spaced above the seat 1 as supported by the struts 5 and the backrest 2. The front ends 8 of the struts 5 are slidably connected to the track 9 so that can be moved to a forward position 10 as shown in FIG. 3, allowing the pivotal connection 11 between the arms and the structs to be moved rearwardly into the temporary straight position shown in FIG. 3. As rearward movement of the pivotal connection 11 continues, the front ends 8 of the struts 5 slide rearwardly guided by the track 9 and the arms pivot to a retracted position wherein the chair arms 4 are vertically oriented to the sides 12 of the chair backrest 2, and the struts 5 are horizontally oriented to the sides 13 of the clear seat 1. Thus, as seen in FIG. 4, the arms are conveniently out of the way for situations in which that condition is desired, such as moving the chair under a table which would interfere with the arms. When it is desired that the armrests be returned to the condition of FIG. 1, the procedure is simply reversed. Sometimes it may be desirable to have one armrest in the raised position and the other in the retracted position. This easily accomplished while the chair is in the position of FIG. 3 by moving one pivot between one arm and its strut rearwardly while moving the connection between the other arm and its strut forwardly.

Figure 5:
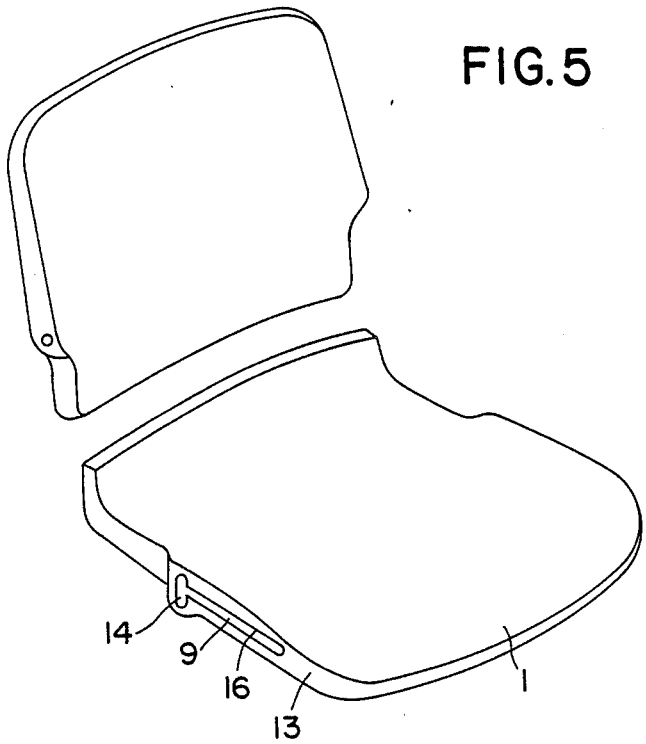
FIG. 5 is a perspective view of the seat and back of the chair of FIG. 2.
Figure 6:
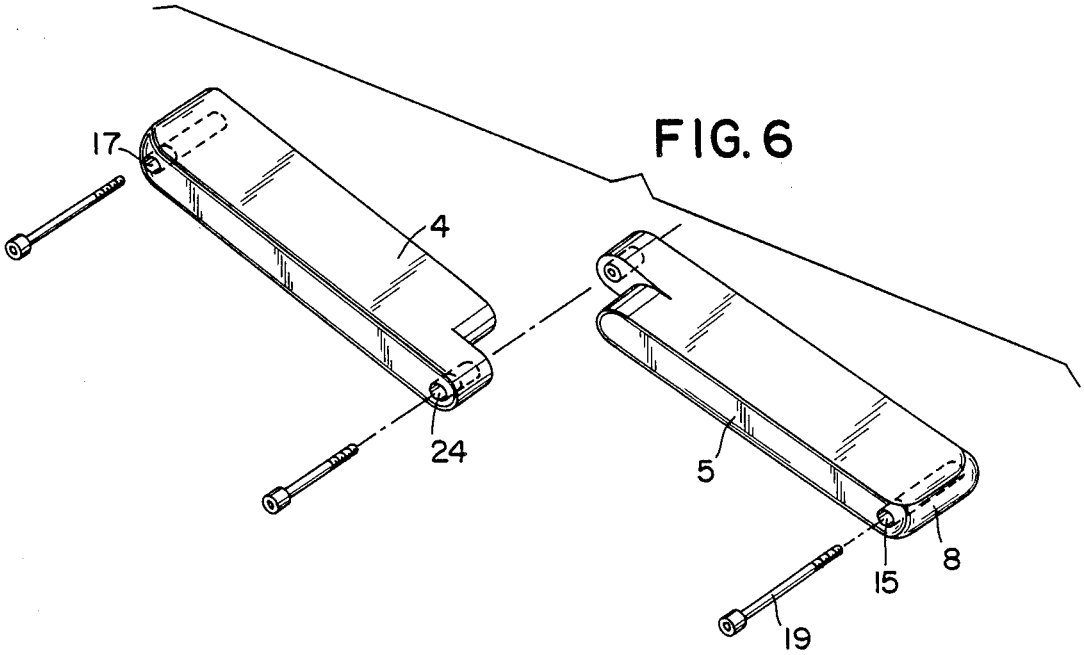
FIG. 6 is an exploded perspective view of the arm and support strut components.
Figure 7:
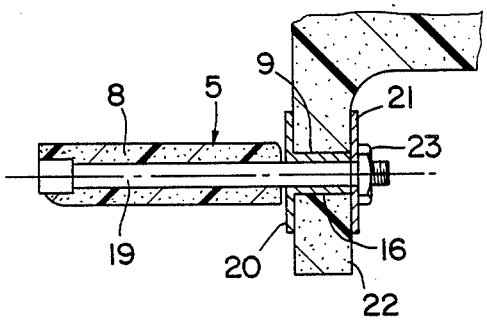
FIG. 7 is a partially exploded, partially sectionalized view illustrating the support strut track on the chair seat and the support strut front end connection thereof.

Referring now to FIGS. 5–7 the chair is seen without the arm 4, struts 5 or pedestal 6 for the purpose of clarity only. The track 9 is seen located along the sides 13 of the seat 1 and is oriented in a substantially horizontal manner. A positional limit slot 14 is located at the rear end of the track for releasably positioning the front end 8 of the struts 5 during the raised position of the arms so that the front end of the struts is can be pulled up from the limit slot 14 and made to engage the horizontal surface 16 of the track 9 for operative displacement.

Referring to FIGS. 6 and 7, the chair arms 4 and struts 5 are seen in an exploded view showing the back pivot 17, arm to strut pivot 24 and strut lower pivot 15. The strut pivot 15 comprises a bolt 19 threaded at one end and inserted thru the strut 5 and a bushing 20 in rotatable engagement thereof. Bushing 20 is slidably and rotatably received within the track slot and is thus free to displace on the track surface 16 from one releasable functional position in engagement with limit slot 14 to any number of positions along the track 9. A washer 21 is received over bolt 19 to provide direct contact between the bushing 20 and a nut 23 on the inside 22 of the seat. Nut 23 secures bolt 19 and therefore strut 5 in firm yet movable and pivotal engagement with the track 9.

It will be obvious to those skilled in the art that various changes may be made without departing from the scope of the invention and the invention is not to be considered limited to what is shown on the drawings and described in the specification and it is applicable to any suitable article of seating.

What I claim is:

1. In a chair comprising a seat;

a back positioned at the rear of said seat;

an independent armrest at each side of the seat having a rear end movably connected to and supported by said back; and an arm support strut having an upper end movably connected to the forward end of said armrest and having a lower end movably connected to said seat, the improvement comprising:

a track provided on each side of the seat for movable engagement of the lower end of each arm support strut, each of said armrests being independently movable from the other while the back and seat remain fixed and having a generally horizontal support position above the seat wherein the strut supports the forward end of the armrest and the back supports the rear end of the armrest, and each of said armrests having a collapsed position wherein the armrest is in a generally vertical position aligned with the edge of the back and said strut is in a generally horizontal position adjacent the edge of said seat.

2. The chair of claim 1, wherein the upper ends of said struts are pivotally connected to said armrests.

3. The chair of claim 1, wherein the upper ends of said struts are pivotally connected to said armrest, and the rear of said armrest are pivotally connected to said back.

4. The chair of claim 1, wherein said arm support strut lower ends includes means for slidably moving along said tracks.

5. The chair of claim 1, wherein each of said tracks define a limit slot for preventing horizontal displacement of said arm support strut lower end when the armrest is in an extended position but allowing manual disengagement of said arm support strut lower end from said limit slot for moving said armrest to a collapsed position and viceversa.

6. The chair of claim 1 wherein said armrests are about equal in length to said support struts.

7. In a method of moving a chair armrest from a raised generally horizontal position adated to support a chair occupant's arm, to a collapsed position, the armrest hingedly joined to a support strut movably positioned in a track having a limit slot along the chair seat, while maintaining the chair seat and back in a fixed posture the steps comprising:

sliding the arm support strut lower end out of the limit slot and along the track to a forward position thereby obtaining a substantially straight alignment between the arm and the support strut and thereafter moving said support strut rearwardly and downwardly to achieve a vertical position of said armrest relative to said back and to position said support strut in a horizontal position relative to said seat edge.

* * * * *